United States Patent [19]

Barnes et al.

[11] 4,360,863

[45] Nov. 23, 1982

[54] LUMINAIRE FOR RESIDENTIAL ROADWAY LIGHTING

[75] Inventors: Jocelyn T. Barnes; Chester A. Hard, III, both of Charlevoix, Mich.; Billy L. Shelby, Memphis; Charles H. Loch, Germantown, both of Tenn.

[73] Assignee: International Telephone and Telegraph Corporation, New York, N.Y.

[21] Appl. No.: 159,829

[22] Filed: Jun. 16, 1980

Related U.S. Application Data

[62] Division of Ser. No. 919,938, Jun. 28, 1978, abandoned.

[51] Int. Cl.[3] ..... F21V 7/09

[52] U.S. Cl. ..... 362/346; 362/217; 362/297; 362/348; 362/375

[58] Field of Search ..... 362/346-350, 362/297, 217, 375

[56] References Cited

U.S. PATENT DOCUMENTS

| | | | |
|---|---|---|---|
| 2,686,255 | 8/1954 | Pascucci | 362/361 X |
| 3,896,302 | 10/1973 | Whitney | 362/341 |
| 4,210,841 | 7/1980 | Vodicka et al. | 362/346 |

*Primary Examiner*—Peter A. Nelson

*Attorney, Agent, or Firm*—James B. Raden; Marvin M. Chaban

[57] ABSTRACT

A luminaire for roadway lighting using a one-piece reflector developing at least two collimated beams in each longitudinal direction. The collimated beams impinge on sloping faces of a refractor to diverge the beams into a regular pattern covering the street with a sharp cutoff at predetermined longitudinal distances from the luminaire. The refractor employs a compressed parabola comprised of radial sections of comparatively large focal length with steps and risers. The complex shape of the one-piece reflector may readily be produced by a reflector finish applied to a molded plastic matrix. In the luminaire, the prismatic surfaces of the inclined walls of the refractor diverge the formerly collimated beams in a carefully controlled manner to produce very uniform distribution of light.

5 Claims, 12 Drawing Figures

LUMINAIRE FOR RESIDENTIAL ROADWAY LIGHTING

This is a division of application Ser. No. 919,938, filed June 28, 1978, and now abandoned.

BACKGROUND OF THE INVENTION

Luminaires for roadway lighting in highway and/or residential areas are, of course, well-known. Such luminaires are generally mounted on a pole or the like at one side of the roadway. The pole may be set back from the roadway with the luminaire elevated adjacent one side of the roadway. The luminaire must transmit beams in each longitudinal direction for a predetermined finite distance calculated to overlap slightly with the beams of the adjacent luminaires on both sides.

On the side facing the roadway or street, the luminaire must fill the space laterally across the street between the longitudinally directed beams. On the back side (or house side in residential areas), the illumination should be muted to limit the intensity of light reaching any house positioned behind the luminaire.

For example, see U.S. Pat. No. 3,561,682 to Rex issued Feb. 9, 1971 in which a luminaire for roadway lighting is shown. In this patent, the luminaire is inclined upwardly in a plane transverse to the roadway. The reflector is an ovate, bowl-shaped one with an ovate bowl-shaped refractor clamped to it.

SUMMARY OF THE INVENTION

The present invention is directed to a luminaire for roadway lighting which uses a compressed, modified parabolic reflector to produce two collimated beams directed down the street and two collimated beams up the roadway. A substantially rectangular inclined wall refractor spreads and diverts the beams to produce beams aimed at the roadway between curbs along the street axis with a sharp cutoff at an angle determined to produce a slight overlap between the light from adjacent luminaires while eliminating excessive brightness above that angle.

The reflector is of one-piece construction preferably of a molded and metallized material. The reflector is comprised of a central domed section flanked by steps and risers, the steps being curved to complete the modified compressed parabola design. The light is initially emitted by a high intensity lamp such as a high pressure sodium lamp of 150 watts, 400 watts or other suitable wattage. Light emitted by the lamp is reflected once by the reflector to develop four collimated beams directed longitudinally of the luminaire, one collimated beam directed toward the house side of the luminaire and one collimated beam directed to the street side.

The beams are spread by prisms on the inside of the refractor and the resulting beams are deflected by prisms on the outside of the refractor to develop the desired output pattern which is subdued on the near side or house side, spread up and down the roadway and directed across the roadway laterally.

It is therefore an object of the invention to provide an improved luminaire for roadway or street lighting using a one-piece reflector which produces a plurality of collimated beams directed for each longitudinal street direction.

It is a further object of the invention to provide an improved one-piece reflector for a luminaire, the reflector using steps and risers to approximate a parabolic reflecting shape, the approximated parabola being compressed into a comparatively small rectangular configuration.

It is a further object of the invention to provide an improved luminaire adapted for roadway or street lighting which utilizes a plurality of collimated beams generated within the luminaire and spreads and directs these beams into a street lighting pattern having a uniform spread in the longitudinal direction up and down the street and having sharp cutoff characteristics on at least one lateral side.

DETAILED DESCRIPTION OF THE DRAWINGS

Figure 1:
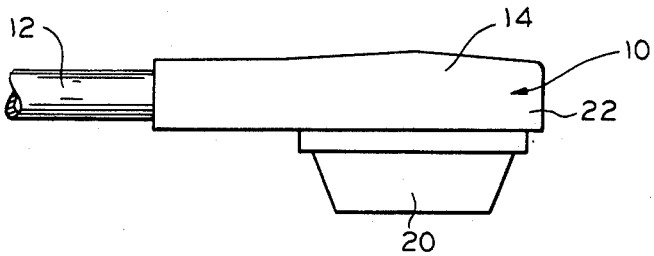
FIG. 1 is a side elevational view of a luminaire employing the invention.
Figure 2:
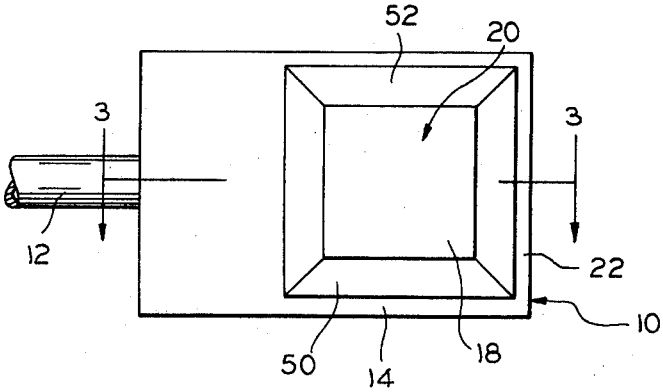
FIG. 2 is a bottom view of the luminaire of FIG. 1.

Shown in FIG. 1 is a luminaire 10 mounted on a horizontal mast 12, the mast being supported on a conventional pole which may be from twenty to thirty feet in height (not shown). The pole may be set back as much as ten to twelve feet from the roadway curb line, in any well-known manner.

The luminaire 10 is essentially rectangular and includes a cover member 14 of conventional design securing the luminaire to the mast 12 and together with the refractor 20 which is secured thereto rendering the luminaire impervious to moisture, rain and insects.

Figure 3:
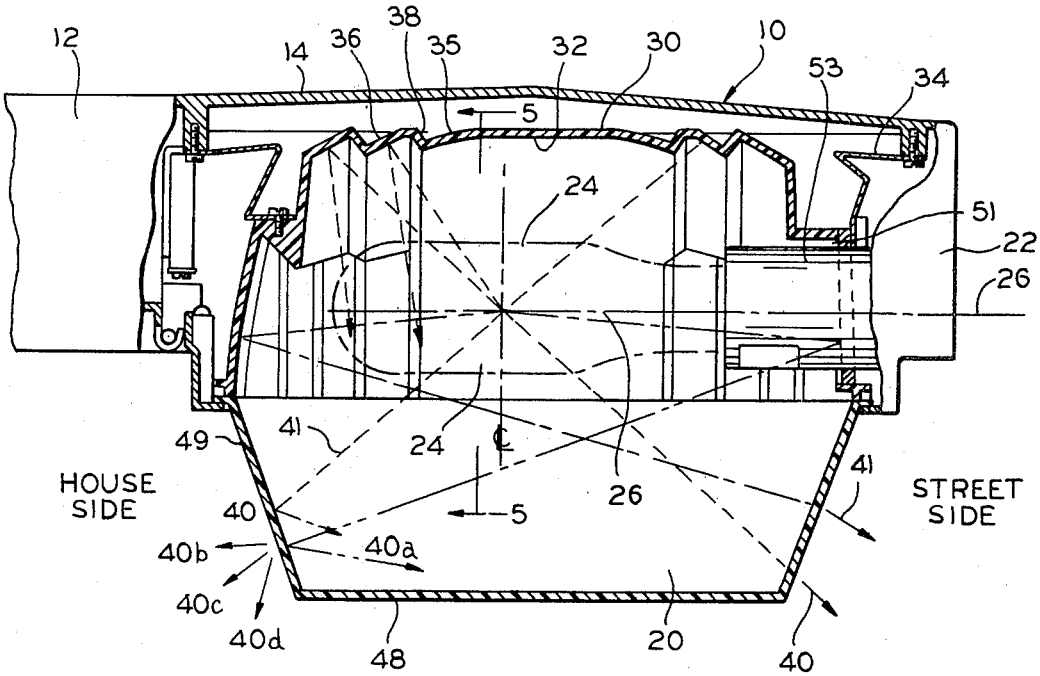
FIG. 3 is a sectional view taken along line 3—3 of FIG. 2.

Affixed to the cover member 14 on the inner roadway or street side 22 of the luminaire (as it is designed to be mounted) is affixed the lamp or light source 24 (FIG. 3).

The light source 24 is a high intensity discharge lamp with its discharge tube arrayed substantially horizontally, the tube being concentric about lamp axis 26. The axis preferably forms the focal point of each curved interior surface of reflector 30.

Figure 4:
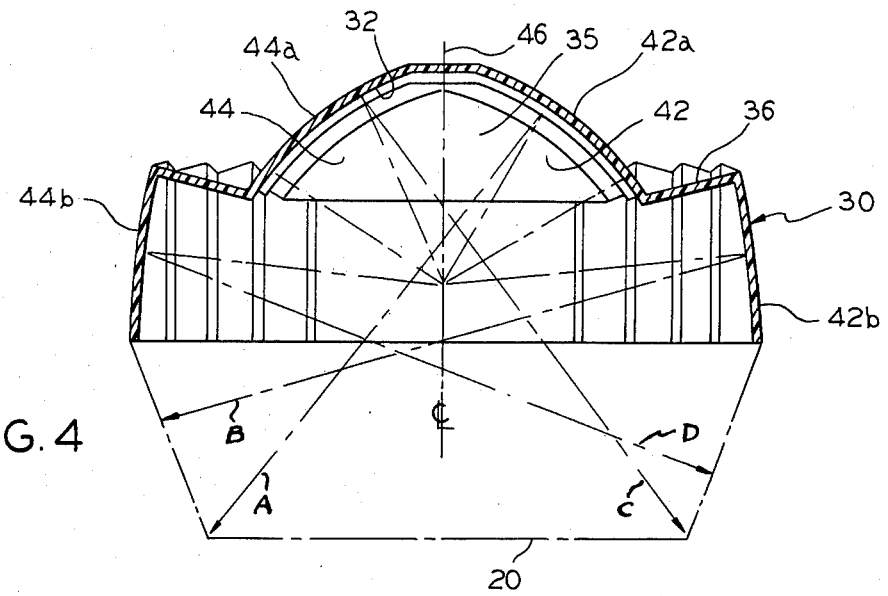
FIG. 4 is a sectional view of the reflector of FIG. 3 (revolved 90° from the showing of FIG. 3) and viewed from the end opposite that having the lamp socket.
Figure 5:
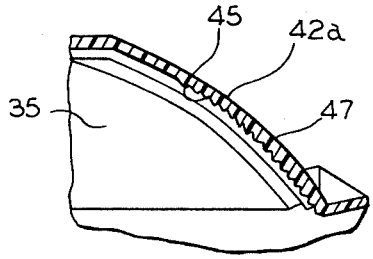
FIG. 5 is a sectional view of the reflector taken along line 5—5 of FIG. 3.

The reflector 30 as shown best in FIGS. 3–5 has a rectangular, domed overall configuration and is of one piece, integral construction. Optimally, the reflector is fabricated by molding and thereafter metallizing the interior surface 32 with a highly specular, or other suitable surface finish, as required. Suitable Z brackets 34 are used for mounting the reflector to the cover member 14 in any conventional manner.

The reflector 30 is symmetrical in its reflective surface 32 about its centerline in the showing of FIG. 3 and in the showing of FIG. 4. The reflector 30 is a compressed parabola defined by a central section 35 which is configured as a modified parabola and outward sections comprised of steps 36 and risers 38. The steps 36 and risers 38 are of circular section to approximate the shape of a parabola and to properly reflect the impinging light rays.

The section shown by FIG. 3 provides light to the near side which is called herein the house side of the luminaire to the area below the luminaire, and to the street side. The reflector is similar in configuration for each of these directions. In each of these directions, one collimated beam is formed. These beams are represented by the arrowed lines 40 and 41 (FIG. 3).

The reflector section as shown by FIG. 4 is configured to produce two collimated beams for each longitudinal or down the street side, a high angle or main beam and a low angle or secondary beam. The central section 35 is domed to produce a modified parabola 42*a* and 44*a* for each respective longitudinal direction. Each modified parabola develops a low angle reflected collimated beam (secondary beams A and C respectively). The modified parabolas 42*b* and 44*b* on each side produce second collimated high angle beams for their respective directions (main beams B and D respectively). Modified parabola 42*a* has a regular pattern of shallow angled steps 45 with risers 47 to provide a further compressed beam (see FIG. 5).

Thus, the reflector 30 forms a total of at least six collimated beams, two for each direction of the luminaire longitudinal to the street, and one beam for each direction lateral to the street.

Figure 5A:
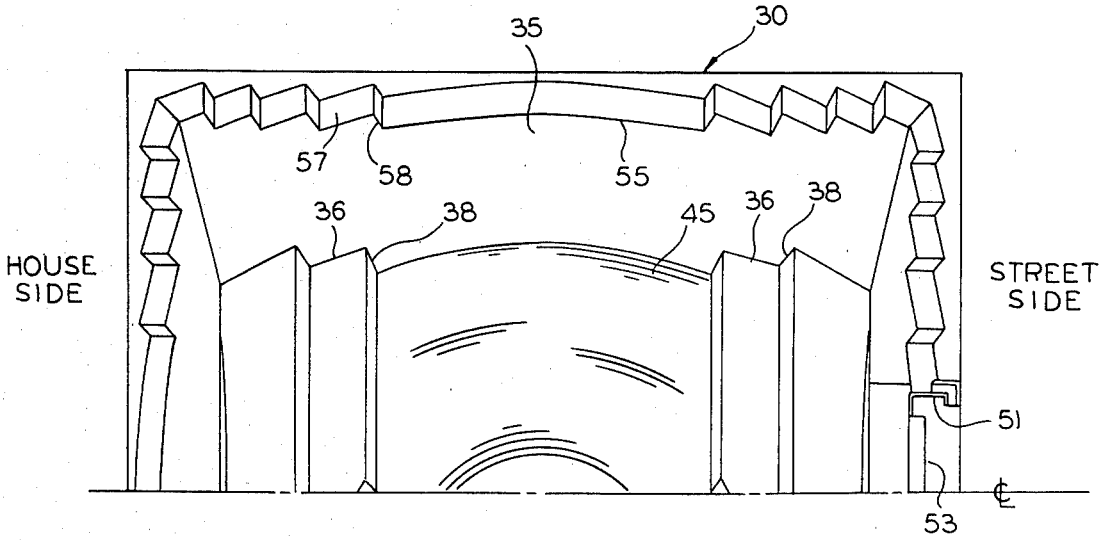
FIG. 5*a* is a bottom view of one half of the reflector of FIGS. 4 and 5, the other half being a mirror image of that shown.
Figure 6:
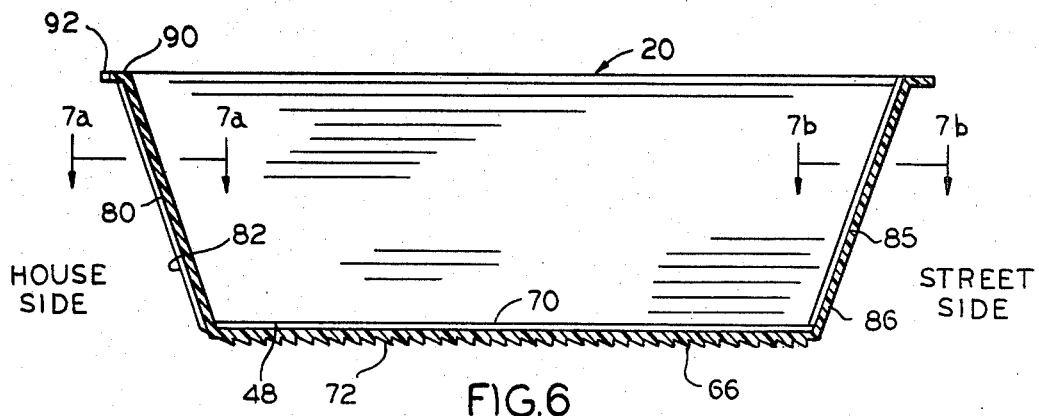
FIG. 6 is a sectional view as in FIG. 3 showing the refractor in greater detail.
Figure 7A:
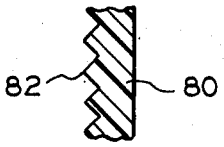
FIGS. 7*a* and 7*b* are sectional views taken along lines 7*a* and 7*b* respectively in FIG. 6.

In FIG. 5*a* there can be seen the rectangular overall configuration of reflector 30. In one wall of the reflector on the house side is an arched cutout 51 for receiving the lamp 24, the lamp fitting within a socket 53 (FIG. 3) secured to the cover member 14. In FIG. 5*a* we show the shallow steps and risers 45 within parabolic section. The steps 36 and risers 38 in the domed section are shown, these steps compressing the modified parabola to generate the main beam for the luminaire.

Also shown are the side steps 57 and risers 59 along with the circular arc 55 which act as a modified parabola forming the lower or secondary beam. The steps 57 and risers 58 are positioned outwardly of the central arc 55 to compress secondary beam. The steps are formed on arcs of successively greater radii circles than that of the central arc. Any of the arcs, such as arcs 55 and 57, may have a common center. A like arrangement of central arc with outer steps and risers is provided on the house side of the reflector to produce a beam for the street side of the luminaire. The street side is similarly configured but may be finished in a light absorptive or non-specular finsish to reduce the amount of light reflected to the house side of the luminaire.

The refractor 20 is frusto-pyramidic with a base 48 and upwardly and outwardly inclined walls 49. The refractor preferably may be fabricated of suitable translucent plastic, of any conventional material.

Figure 9:
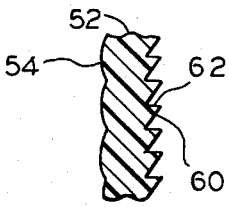
FIG. 9 is a sectional view taken along line 9—9 of FIG. 8, the showing being typical of opposite side also.
Figure 7B:
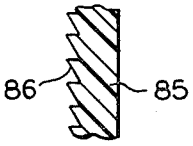
Figure 8:
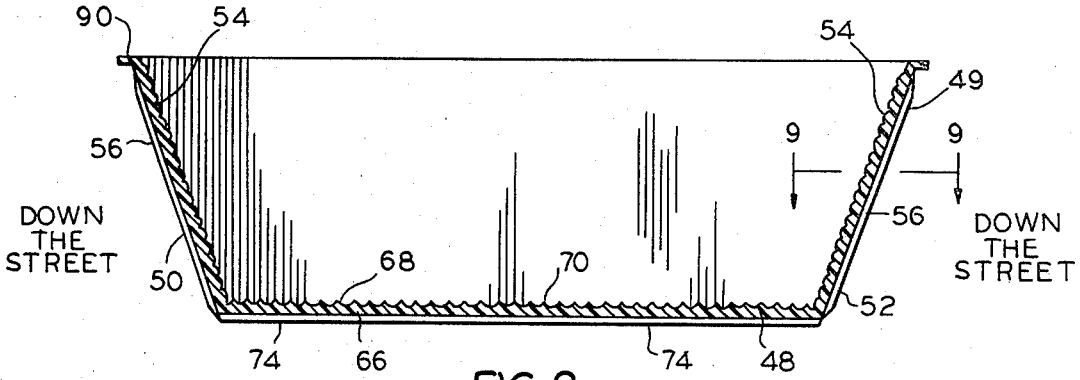
FIG. 8 is a sectional view of the refractor of FIG. 6 revolved 90°.

Within the trough-shaped refractor 20 (FIGS. 6–9), the two longitudinal sides 50 and 52 are essentially identical. Both such sides have gently curved, repetitive pillow prisms 54 on the interior of the refractor to spread the respective main beams vertically from approximately 72.5° to a maximum intensity at about 75.5° vertically and laterally about 10° on each side of the luminaire centerline. On the outside of each longitudinal sidewall, the side is configured with repetitive triangular prisms 56 having constant vertical cross-section of the type shown in FIG. 9. These triangular prisms 56 act to refract and turn the beams toward the street. The prism side of greater slant height 60 (FIG. 9) is directed toward the street side of the luminaire, inclining the beams toward the center of the street. The more upright prism sides 62 are risers which provide little direct control but do internally reflect stray rays back into the prism side of greater slant height to incline the rays toward the center of the street.

The base 66 of the refractor has on its inner surface curved, otherwise triangular prisms 68. These prisms are repetitive symmetrical ones each having a continuous ridge 70 extending from house side to street side (see FIG. 6). These prisms raise the lower angle beams from the reflector from 0° to a maximum intensity at about 72.5° vertical complementing the main beams described above.

On the outside of the wall 66, base 48, an alignment of repetitive triangular prisms 72 is provided. Each such prism has a continuous ridge 74 extending longitudinally the walls of the prisms directing light toward the street side and confining the light on the house side (see FIG. 6).

On its house side, the refractor sidewall 80 has on its outer surface vertically continuous symmetrical 90° reflective prisms 82 (FIG. 7*a*) to reflect the light rays back toward the street side. The interior of the house side of the refractor is essentially plane or flat with no prisms.

On the street side of the refractor 20, the interior of the refractor wall 85 (FIG. 7*b*) has a series of vertical prisms to spread the beam down the street side curb line. On its outside wall, the refractor 85 has repetitive horizontally continuous symmetrical visor prisms 86 to deflect light downward to the street side curb line.

The refractor may be mounted on the housing in any suitable manner such as rim 90 and rim mounting tabs such as 92.

Figure 10:
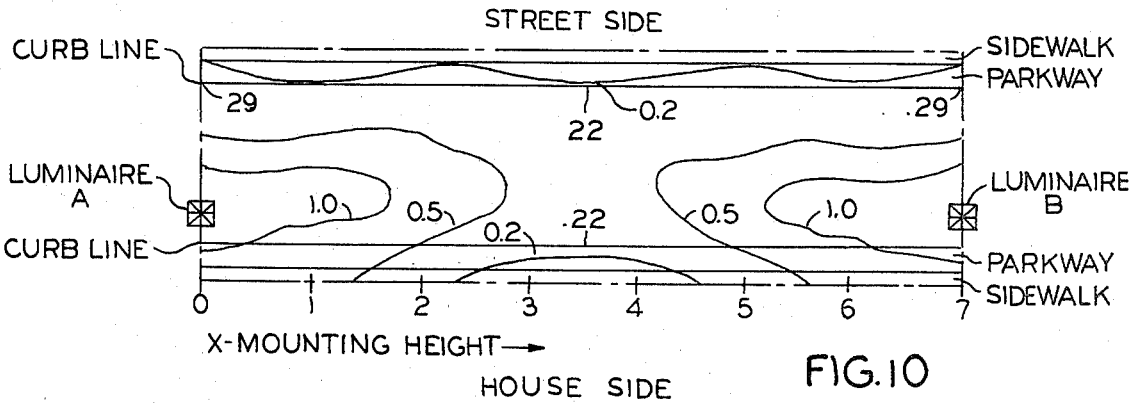
FIG. 10 is a typical roadway illumination level diagram using luminaires of our invention.

In FIG. 10, we show the arrangement of two adjacent luminaires A and B relative to a street and to one another. The horizontal axis of FIG. 10 is a multiplier of the mounting height of the luminaires. As shown, the luminaires are spaced a distance of seven mounting heights (MH) apart. As far as the lateral or across the street distance, each luminaire is spaced about 0.6 MH from the inner edge of the near sidewalk and about 2.0 MH from the far curb. In a sample installation for a roadway with about sixty-six feet between property lines (the inner edge of the sidewalks), the mounting height may be 30 feet, the spacing between luminaires would be 210 feet, and the distance between property lines (at the inner edge of the respective sidewalks) would be about sixty-six feet.

With a 150 watt high pressure sodium lamp, the isolux plot of the luminaires may be seen in FIG. 10, with the light at the curb lines being about 0.22 foot candles. The average number of foot candles on the roadway is 0.66 foot candles.

Summarizing, the construction disclosed is adapted for high intensity discharge luminaires and is based on using sections of parabolas placed one adjacent to the other with "risers" connecting the ends of each adjoining parabolic section. The parabolic section used at the center is relatively wide and was originally constructed as a double axis parabola. Since it lies directly opposite the lamp, the ideal design provides for rays from the front end of the lamp to be reflected by the front portion of that reflector in a direction parallel to the axis of the roadway, while the rays from the back of the light source reflecting off the same portion of the reflector, will angle forward of the line parallel to the axis of the roadway and will impinge upon the refractor panel at its extreme front limit. In laying out the double axis parabola, we found that a radius of a circle closely approximates the more complex construction of the double axis parabola. The radius is also much easier to physically produce, particularly since a different radius must be used vertically in order to obtain a similar type of control in the vertical direction, as shown by the beams of FIG. 3. A parabola is preferred, however, since such a small portion of the parabolic section is used, a small segment of a circle closely approximates that contour. In the vertical plane, the light source is essentially a point, and the radius can be selected that will either enlarge the beam slightly or compact the beam slightly so that again all rays incident to the refractor fall within the limits of the refractor panel.

As we leave the center section of the side reflector panels and move toward the street or house end of the reflector panels, the reflective segments become smaller and smaller (FIG. 3). The use of these radii to all intents and purposes exactly duplicate the parabolic contour that would be developed for these very small areas. The risers that join these reflective surfaces are also metallized and are angled slightly toward the farther end of the light source. This avoids any wasted ray traces and permits a correcting reflection from the near end of the light source on the riser surface which then is reflected onto the reflective surface, and redirected virtually parallel to the ray trace from the far end of the light source. This results in a far better collimation of the reflected beam than would be achieved with the riser angles aimed at the center or near end of the light source.

Other designs could use fewer but larger segments, or more, but smaller segments and thereby change the segment dimensions, but within any given zone fore or aft of the luminaire centerline, the radius of the arc of a circle that approximates that segment of a parabola would necessarily be the same as shown; unless the reflective surface are made significantly closer to the light source, or significantly further from the light source. If closer to the light source, temperature problems would arise. If further from the source, the reflector would be significantly larger as would the refractor, both of which would contribute significantly to the cost of the luminaire.

We claim:

1. A one piece reflector for use in a luminaire, said reflector having a top wall with side walls essentially rectangularly oriented about a light source with said walls symmetrical about the centerline of the light source to form an open bottom reflector structure with rectangular corners, said walls comprising a stepped parabolic specular reflector producing at least two collimated beams on each side of said centerline, each side wall of the reflector including a plurality of internal steps adjacent the corners of the housing with an internally concave continuous midsection, each said step being generally perpendicular to the axis of the light source, the top wall having an outwardly domed arcuate midsection with essentially flat lateral sections outwardly of the domed section, said domed section including arcuate steps adjacent the axial ends of the centerline to combine with said sidewalls to produce said at least two collimated beams along each lateral side wall.

2. A reflector as claimed in claim 1, in which the side wall steps are arcuate relative to the axis of the light source.

3. A reflector as claimed in claim 1, in which each step has a shallow riser angled toward the center of the reflector.

4. A reflector as claimed in claim 1, in which successive steps toward the center of each wall are successively longer than the steps more adjacent the corners of the reflector.

5. A reflector as claimed in claim 1, in which said domed section includes arcuate steps about the centerline of the reflector adjacent the axial ends of the reflector.

* * * * *

UNITED STATES PATENT AND TRADEMARK OFFICE

CERTIFICATE OF CORRECTION

PATENT NO. :4,360,863

DATED :November 23, 1982

INVENTOR(S) :Jocelyn T. Barnes et al

It is certified that error appears in the above-identified patent and that said Letters Patent is hereby corrected as shown below:

On the title page, item (62) "abandoned" should be deleted and -- Pat. No. 4,234,912 -- substituted therefor.

Column 1, line 2, "and now abandoned" should read -- now U.S. Pat. No. 4,234,912 --.

Signed and Sealed this

Twenty-ninth Day of March 1983

[SEAL]

Attest:

GERALD J. MOSSINGHOFF

Attesting Officer

Commissioner of Patents and Trademarks